US007784520B2

(12) United States Patent
Paulson

(10) Patent No.: US 7,784,520 B2
(45) Date of Patent: Aug. 31, 2010

(54) GARAGE MECHANISM PROTECTOR

(75) Inventor: Rick Paulson, 790 Hill Farm Rd., Hudson, WI (US) 54016

(73) Assignee: Rick Paulson, Hudson, WI (US)

( * ) Notice: Subject to any disclaimer, the term of this patent is extended or adjusted under 35 U.S.C. 154(b) by 331 days.

(21) Appl. No.: 11/454,231

(22) Filed: Jun. 16, 2006

(65) Prior Publication Data

US 2008/0000594 A1 Jan. 3, 2008

(51) Int. Cl.
*E05D 15/00* (2006.01)

(52) U.S. Cl. ..... 160/201; 160/40; 16/91; 16/94 R; 16/96 R; 49/197; 49/199; 49/460

(58) Field of Classification Search ..... 160/201, 160/40; 16/91, 94 R, 96 R; 49/197, 199, 49/460

See application file for complete search history.

(56) References Cited

U.S. PATENT DOCUMENTS

| | | | | | |
|---|---|---|---|---|---|
| 2,124,970 | A * | 7/1938 | Bagley | 292/40 |
| 2,619,165 | A * | 11/1952 | Wolf | 160/191 |
| 3,412,780 | A * | 11/1968 | Moler | 160/191 |
| 4,957,301 | A * | 9/1990 | Clay et al. | 277/345 |
| 5,435,104 | A * | 7/1995 | Dietrich | 49/493.1 |
| 5,489,130 | A * | 2/1996 | Clark | 292/66 |
| 5,954,111 | A | 9/1999 | Ochoa | 160/201 |
| 6,098,696 | A * | 8/2000 | Styra | 160/201 |
| 6,227,281 | B1 * | 5/2001 | Martin | 160/201 |
| 6,250,360 | B1 | 6/2001 | Ochoa | 160/201 |
| 6,374,567 | B1 * | 4/2002 | Mullet | 52/716.1 |
| 6,463,988 | B1 * | 10/2002 | Mullet et al. | 160/201 |
| 6,540,003 | B1 * | 4/2003 | Martin | 160/201 |
| 6,554,047 | B1 | 4/2003 | Mondragon et al. | 160/201 |
| 6,669,156 | B2 * | 12/2003 | East et al. | 248/300 |
| 6,745,814 | B2 * | 6/2004 | Hoofard et al. | 160/201 |
| 6,840,300 | B2 * | 1/2005 | Lewis, Jr. | 160/201 |
| 6,928,696 | B2 * | 8/2005 | Wartman | 16/99 |
| 7,114,753 | B2 * | 10/2006 | Nodorft | 292/137 |
| 2003/0213093 | A1 * | 11/2003 | Perks | 16/91 |
| 2005/0155723 | A1 | 7/2005 | Johnston et al. | 160/133 |
| 2005/0155724 | A1 | 7/2005 | Johnston et al. | 160/201 |
| 2007/0113990 | A1 * | 5/2007 | Preising, Jr. | 160/201 |
| 2008/0083166 | A1 * | 4/2008 | Brown et al. | 49/197 |
| 2009/0044917 | A1 * | 2/2009 | Meichtry | 160/201 |

* cited by examiner

*Primary Examiner*—Katherine W Mitchell
*Assistant Examiner*—Philip S Kwon
(74) *Attorney, Agent, or Firm*—Vidas, Arrett & Steinkraus

(57) ABSTRACT

The safety shield is formed of an elongate L-shaped rail shield engaged to a vertical surface adjacent a vertical rail located within the interior of a garage door. An L-shaped panel shield is engaged to the interior of each garage door panel proximate to the vertical rail. The L-shaped panel shield is on the opposite side of the rail relative to the L-shaped rail shield. A generally U-shaped end covering shield may be integral or engaged to said L-shaped rail shield, where the L-shaped panel shields are positioned interior to the panel shield face side of the U-shaped end covering shield.

27 Claims, 5 Drawing Sheets

GARAGE MECHANISM PROTECTOR

BACKGROUND OF THE INVENTION

Garage doors for buildings, are generally mounted to a garage door rack assembly. The garage door rack assembly is usually formed of opposite rails positioned proximate to each side of a garage door. Each garage door rail includes an interior channel designed for receiving engagement of a roller which is rotatably mounted on a shaft. The shaft is usually engaged to a bracket, which in turn, is affixed to the interior of adjacent garage door panels. Generally, the rails of the garage door rack assembly extend vertically upward from a garage floor a sufficient distance to permit entry of a vehicle into a garage. The rails then generally curve and extend horizontally with respect to a garage floor to hold the garage door panels in an open position. The horizontal position of the rails is preferably of sufficient height to not contact the roof of a vehicle positioned within a garage.

The cable, rails, interior channels, and rollers for the garage door rack assembly are generally formed of metal having sharp edges. A child's or adult's appendages may easily be cut, severed, and/or crushed by inadvertent contact with the garage door rack assembly, particularly during the elevation and/or lowering of a garage door, during use of an automatic garage door opener.

As known, individuals returning home or to a structure are generally prevented from observing the presence and location of individuals within a garage when the garage door is in a closed position. An individual in this situation, activating an automatic garage door opener, will have no knowledge that an individual within a garage may be in close proximity to a garage door rack assembly and thereby be exposed to risk of injury during the opening of a garage door.

In other situations, an individual returning home or to a structure, may activate an automatic garage door opener at a distance from the structure where observation of the interior of a garage is not permitted. In this situation, a vehicle operator will have no knowledge that an individual is within a garage having an open garage door. A person in close proximity to a garage door rack assembly, which has not obstructed an optic safety device, may therefore be exposed to risk of injury during the closing of a garage door.

No device is known which functions as a garage door rack assembly shield to minimize risk of injury to children and/or adults during the activation of an automatic garage door opener for a garage.

The garage door rack assemblies as known frequently utilize a cable as engaged to a load bearing spring or drum to assist in the elevation of a garage door. The cable is usually positioned vertically proximate to each rail of the garage door rack assembly. Frequently, the rails of the garage door rack assembly are positioned a sufficient distance outwardly from a garage door frame to expose the cable. No garage mechanism safety shield is known which prevents an individual from placing an arm and/or appendages in proximity to the cable to minimize risk of injury.

In general, the majority of automatic garage door systems include an optic safety device proximate to the floor of a garage. The optic safety device functions to terminate the closing of a garage door in the event that the optic beam of the safety device is broken.

In a situation where the optic safety device is obstructed while the garage door is in a lowered or in a closed position, and the electronic garage door opener is activated, the garage door will continue to open even though the optical path of the safety device remains obstructed. An individual in the proximity of the rails of the garage door rack assembly in this situation is therefore at a substantial risk of injury during the opening of a garage door. An individual opening the garage door will therefore not normally be able to halt a garage door elevation to avoid or minimize injury.

A number of individuals having automatic garage door openers with optic safety features are also unaware that the pressure sensitivity of the automatic garage door opener is sufficiently high, so that a garage door will continue to open or close during the presence of an obstruction, in at least one of the open interior channels. In this situation the obstruction is frequently an appendage of a hand. Also, a number of individuals are unaware that in the event that sufficient pressure is exposed to an activated garage door opener, then the direction of movement of the garage door does not reverse relative to the obstruction, but stops the movement of the garage door at the location of the obstruction. In fact, the pressure caused by an obstruction on an electric garage door opener system, may be sufficiently high for the top sections of the garage door to buckle and/or bend prior to the termination of the advancement or retraction of the garage door. In addition, the presence of an obstruction may be sufficient to jam a roller within an interior channel of a rail such that the release cord is rendered inoperable. An individual would then be required to activate the electronic garage door a second time to open, or initiate a reversal or the direction of movement of the garage door, to free the obstruction and/or individual. An individual could therefore be pinned into place and severely injured by a garage door opener having an unprotected garage door rack assembly.

Frequently, the garage door as engaged to an electronic garage door opener is the largest and most dangerous moving machinery at a home. As known, generally no protective device exists to minimize risk of injury to individuals during use of the garage door rack assembly.

A need therefore exists for a garage door safety shield to protect individuals from the rails, cable, internal channel, track, and/or rollers of a garage door rack assembly.

BRIEF SUMMARY OF THE INVENTION

The safety shield for a garage door rack assembly generally includes an L-shaped rail shield, a plurality of L-shaped panel shields, and a U-shaped end covering shield. The L-shaped rail shield is engaged to a vertical surface adjacent a garage door opening. The L-shaped rail shield includes a mounting leg used to engage the rail shield to the vertical surface. The rail shield also includes a shield face extending outwardly from a vertical surface. The shield face is generally positioned proximate to the closed back surface of a vertical rail of the garage door rack assembly. The rail shield extends vertically from a location proximate to a garage floor to a location proximate to the upper curve of the rail. A rail shield is used on each side of a garage door as adjacent to the opposite rails of the garage door rack assembly.

A plurality of panel shields are used for engagement to the interior of individual garage door panels. Each of the panel shields generally includes an engagement leg used to secure the panel shields to the interior of a garage door panel. Each panel shield also generally includes a panel shield face extending outwardly from each garage door panel. Each panel shield face is preferably positioned proximate to the open internal channel of the vertical rails of the garage door rack assembly. Each of the panel shields are preferably vertically aligned relative to one another, and extend from a location proximate to a garage floor to a position proximate to the upper curve of the vertical rails. The panel shield faces generally include a lower edge having an angular cutout and an upper edge which may also include an angular cutout.

The lower edge of the panel shield faces may also include a curved portion disposed inwardly toward the vertical rail to facilitate slidable movement relative to the U-shaped end covering shield. Each lower edge having the angular cutout, with the exception of the bottom panel shield, is preferably proximate to and above an upper edge of an adjacent panel shield face. The elevation of the garage door proximate to the upper curve of the rail enables the lower edges of a respective panel shield face to move downwardly relative to the upper edges of an adjacent panel shield face, to permit a respective garage door panel and panel shield to traverse the upper curve of the vertical rail. Generally, the lower edges of a panel shield having the angular cutout, and the upper edge of an adjacent panel shield, are each proximate to a bracket, having a shaft and roller positioned within the internal channel of the vertical rails.

The U-shaped end covering shield preferably includes a rail shield face side, a transition shield, and a paneled shield face side. The rail shield face side preferably has a sufficient width dimension for outward positioning relative to the vertical rails. The rail shield face side is preferably securely attached to the shield face of the L-shaped rail shield. The U-shaped end covering shield preferably extends from a location proximate to a floor of a garage to the upper curve of the vertical rail. The transition shield is preferably exterior to the outer edge or the outer curved portion of the vertical rail. The panel shields are preferably slidably disposed interior to the panel shield face side of the U-shaped end covering shield. The panel shield face side of the U-shaped end covering shield preferably includes a top edge having an arcuate surface disposed outwardly from the vertical rail. The arcuate surface preferably acts as a guide to engage the curved portion of the lower edge of at least one of the panel shields to facilitate the slidable positioning of the panel shield faces internally with respect to the panel shield face side of the U-shaped end covering shield.

BRIEF DESCRIPTION OF THE SEVERAL VIEWS OF THE DRAWING(S)

DETAILED DESCRIPTION OF THE INVENTION

Figures 1, 6:
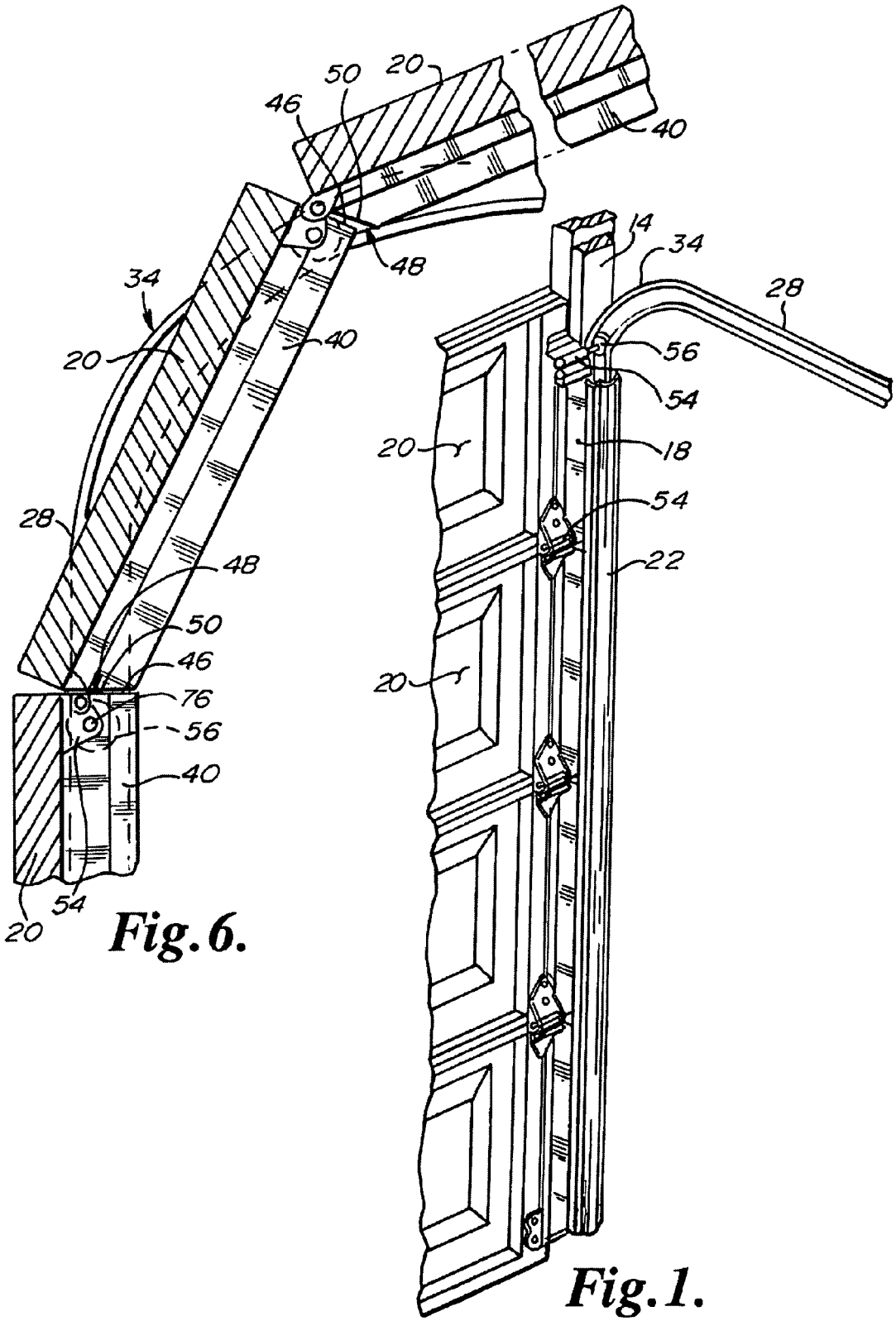
FIG. 1 is an isometric environmental view of the safety shield relative to a garage door rack assembly.
FIG. 6 is an environmental side view of the panel shields adjacent the upper curve of the vertical rail.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

The safety shield for the garage door rack assembly is generally referred to by the numeral 10. In at least one embodiment, the safety shield 10 encloses the rollers 56, vertical garage door rail 28, the open or internal channel 42, and/or the cable 58, which are used in combination to elevate and/or lower a garage door 68, relative to a garage floor.

In some embodiments, the garage door rack assembly includes two vertical rails 28, where each vertical rail 28 is disposed on opposite sides of the garage door 68. Each vertical rail 28 is disposed for positioning of the open or internal channel 42 towards each other, or toward the center of the garage door 68.

The description of the invention herein is generally restricted to a description of the safety shield 10 as disposed about one of the vertical rails 28. It should be noted that the description for the positioning of the safety shield 10 about the second vertical rail 28 will generally be opposite or a mirror image of the description herein.

The safety shield 10 protects the appendages, arms, legs, and/or feet of individuals proximate to a vertical rail 28 during the opening or closing of the garage door 68. The safety shield 10 in some embodiments is adjustable for use with most, if not all, garage door rack assemblies. In some embodiments, the safety shield 10 is formed of recycled plastics which have a relatively high tolerance to hot or cold environmental conditions.

In some embodiments, the cables 58, vertical rails 28 and rollers 56 are completely enclosed within the safety shield 10.

In at least one embodiment, the safety shield 10 is formed of an L-shaped rail shield 12, a plurality of L-shaped panel shields 18, and a U-shaped end covering shield 22.

In at least one embodiment, the L-shaped rail shield 12 is disposed proximate to both of the vertical rails 28 and is adjacent to the closed back surface 30 of each vertical rail 28.

In some embodiments, the L-shaped rail shield 12 is elongate extending vertically upward from a position proximate to a garage floor to an upper curve 34 of the vertical rails 28. The L-shaped rail shield 12 may include a mounting leg 24 and a shield face 26 extending substantially perpendicularly outward from the mounting leg 24. The mounting leg 24 is positioned adjacent to a vertical surface, stud, or other structure 14 of a garage wall. Fasteners such as screws, bolts, nails, or other mechanical or adhesive fasteners may be used to secure the mounting leg 24 to the vertical surface 14. In some embodiments, the mounting leg 24 is disposed inwardly for positioning between the vertical rail 28 and the vertical surface 14. In other embodiments, the mounting let 24 is disposed outwardly from the back 30 of the vertical rail 28.

The shield face 26 may also extend substantially perpendicularly outward from the vertical surface 14 for positioning adjacent to the closed back surface 30 of the vertical rails 28.

In at least one embodiment, the mounting leg 24 is proportionately sized relative to the shield face 26. The mounting leg 24 generally has a width dimension of between ½ inch and 4 inches. However, the width dimension for the mounting leg 24 may be larger than 4 inches and smaller than ½ inch for use with different types of garage door rack assemblies. In some embodiments, the shield face 26 has a width dimension of between 2 inches and 10 inches. However, the width dimension for the shield face 26 may be larger than 10 inches and smaller than 2 inches for use with different types of garage door rack assemblies. The width dimension selected for the shield face 26 is preferably sufficiently large to enable engagement of the U-shaped end covering shield 22 to the shield face 26 for positioning exterior to the vertical rail 28.

In some embodiments, an expansion shield 74 may be affixed to the shield face 26 to extend outwardly therefrom. (FIG. 4A) The expansion shield 74 is also preferably positioned substantially perpendicularly outward from the vertical surface 14. The expansion shield 74 may be engaged to the shield face 26 through the use of either mechanical fasteners and/or adhesives as desired. Examples of mechanical fasteners include, but are not necessarily limited to, screws, bolts and nuts, rivets, nails, snaps, mating channels or penetrating and receiving members.

Examples of adhesives include, but are not necessarily limited to, the use of thermoplastic, water-based, reactive chemistries and solvent based adhesives. Thermoplastic adhesives may be based on polymers including, but not limited to, polyolefin's, including polyethylene and polypropylene, polyamides, polyurethanes, polyesters, polyacrylates, elastomeric block copolymers, and any co-polymers axed terpolymers thereof. Ethylene vinyl acetate, ethylene methyl acrylate, ethylene-n-butyl acrylate, and so forth, are commonly employed copolymers of ethylene, and homopolymers of ethylene and propylene are commonly employed in thermoplastic adhesives as well. Another class or ethylene copolymers include those referred to in the art as interpolymers of ethylene having at least one C3 to CZO alphaolefin.

Thermoplastic pressure sensitive adhesives may also find utility herein and commonly incorporate rubbery block copolymers such as the styrenic block copolymers including, but not limited to, styrene-isoprene-styrene (SIS), styrene-butadiene-styrene (SBS), styrene-ethylene/propylene-styrene (SEPS), styrene-ethylene/butylene-styrene (SEBS), styrene-isobutylene-styrene (SIBS), and so forth.

Thermoplastic adhesive compositions may suitably also include tackifying resins, plasticizers, oils, waxes, antioxidants, and any combination thereof, as well as other additives known to those of skill in the art.

Water based pressure sensitive adhesives may also find utility herein. Such adhesives commonly incorporate polyacrylic polymers such as styrene-acrylic copolymer, vinyl-acrylic, vinyl ester/vinyl acetate/acrylic; ethylene vinyl acetates, polyurethanes; polyurethane-acrylic hybrids; polyanudes; styrene-butadiene rubbers; polychloroprenes; acrylonitrile-butadiene-styrene; polyisoprenes; polyisobutylene; polyurea; natural latex; polysaccharides; gum resins; polyvinyl alcohols; and combinations thereof.

Thermoset adhesives which are cured by heat, chemical reaction or and/or irradiation, may also be employed herein. There are a variety of thermoset adhesives including heat curing, moisture curing and UV curing, for example. Many such adhesives also come in one and two-part formulations.

UV curable adhesive compositions may be employed herein. Suitable UV curable compounds include those having (meth)acrylate functionality such as epoxy(meth)acrylates, urethane(meth)acrylates, polyester(meth)acrylates, acrylic (meth)acrylates, and so forth.

Moisture curable compositions may be employed herein. Examples of suitable moisture cures include polyurethanes and polyorganosiloxanes.

In addition examples of suitable two-component curing systems may include epoxies, polyurethanes, acrylics, and so forth.

In addition, in alternative embodiments the adhesives utilized may preferably be epoxy and/or curable compositions in substitution for mechanical attachment fasteners as indicated herein. The elements of the rail shield 12 and U-shaped end covering shield 22 may also be alternatively bonded together through the use of laser bonding techniques and/or lap welding techniques.

The above list is intended for illustrative purposes only, and not as a limitation on the scope of the present invention.

Of course, the adhesive compositions may include other additives known to those of ordinary skill in the art.

In some embodiments, the L-shaped rail shield 12, mounting leg 24, and shield face 26 are formed of materials other than plastic. For example, materials such as wood, aluminum, stainless steel, carbon steel, fiberglass, and composite materials may be used to form the rail shield 12. In some embodiments, the L-shaped rail shield 12 is formed of sufficiently sturdy material to not fracture and/or fail during the enclosure of the garage door rack assembly.

In some embodiments, the L-shaped panel shields 18 each include an engagement leg 38 and a panel shield face 40 which extends substantially perpendicularly outward from the engagement leg 38. Each panel shield 18 is preferably engaged to a garage door panel 20 proximate to an exterior edge 44. Each garage door panel 20 has at least two panel shields 18 located on opposite ends, proximate to each exterior edge 44.

Figure 5:
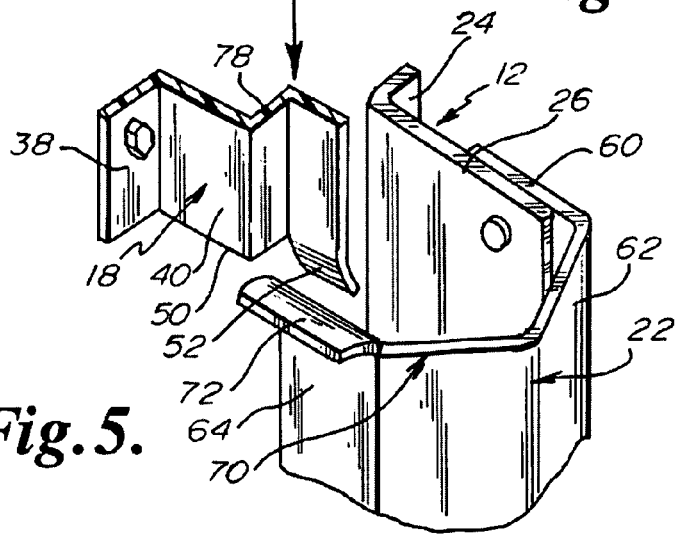
FIG. 5 is a detail partial isometric view of the engagement between the panel shield faces to the panel shield face side of the U-shaped end covering shield as viewed from the line 5-5 of FIG. 3.
Figure 3:
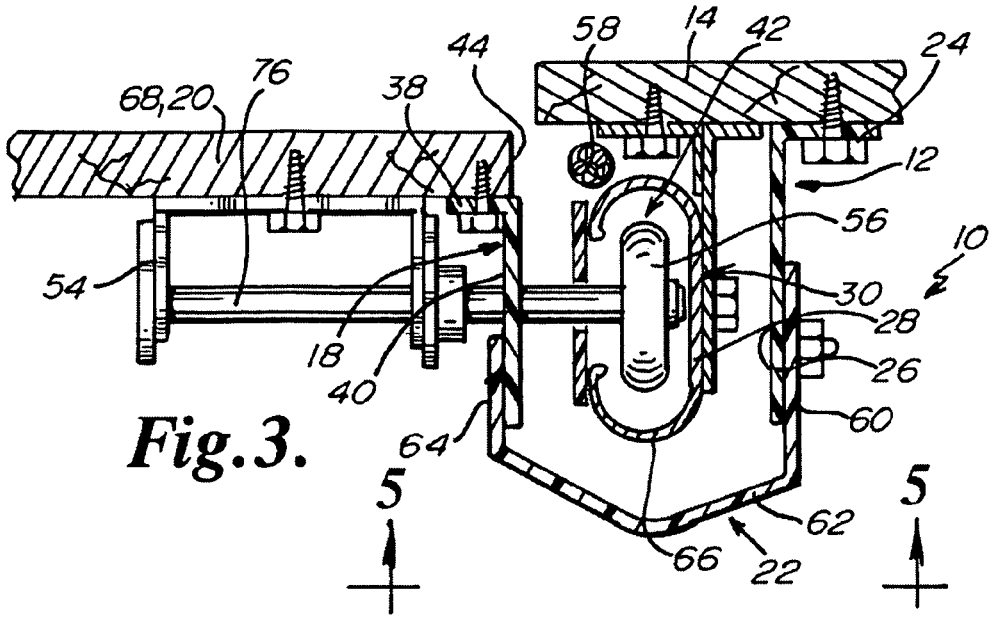
FIG. 3 is a cross-sectional top view of the safety shield taken along the line of 3-3 of FIG. 2.
Figure 4:
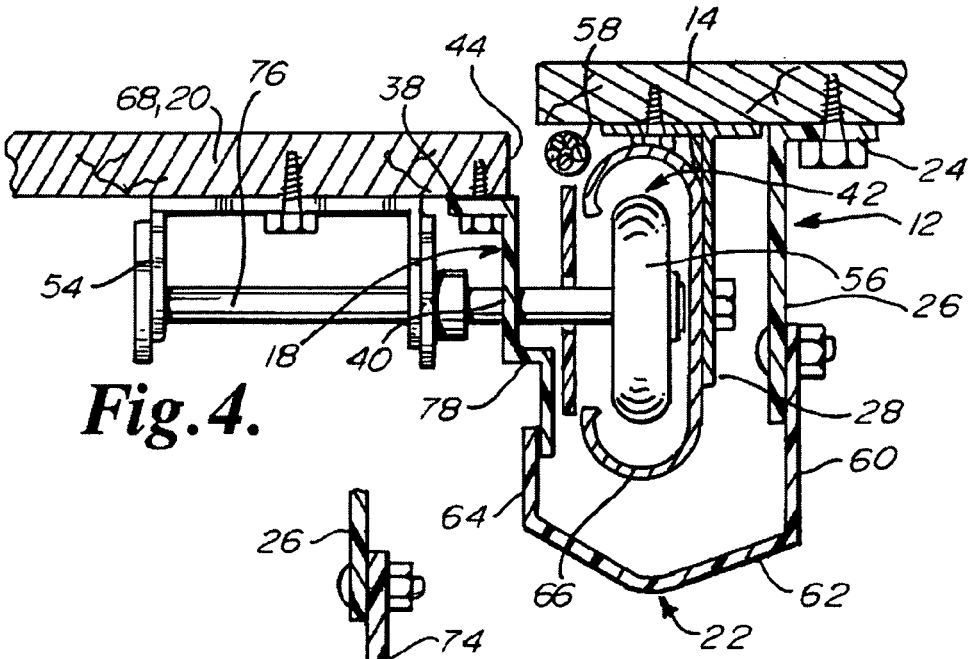
FIG. 4 is an alternative cross-sectional top view of the safety shield taken along the line of 3-3 of FIG. 2.

In some embodiments, as may be seen in FIGS. 3, 4, and 5, the panel shield faces 40 may alternatively be either substantially planar (FIG. 3) or include a shoulder 78 disposed inwardly toward the vertical rail 28 (FIGS. 4 and 5). The shoulder 78 facilitates the positioning of the panel shield faces 40 interior to the panel shield face side 64 of the U-shaped end covering shield 22. Alternatively, the panel shield face side 64 may extend outwardly a sufficient distance for positioning exterior to a planar panel shield face 40.

In at least one embodiment, the engagement leg 38 is engaged to the interior surface of a garage door panel 20 through either mechanical or adhesive attachment. Examples of mechanical fasteners include, but are not necessarily limited to, screws, bolts and nuts, rivets, nails, snaps, mating channels and/or penetrating and receiving members. Examples of adhesives have been previously identified herein.

In at least one embodiment, a garage door 68 is formed of a plurality of adjacent garage door panels 20. Adjacent garage door panels 20 are engaged together through the use of roller brackets 54 which, in turn, include a roller shaft 76 and a roller 56 rotatably engaged to the distal end of the roller shaft 76. Each roller 56 is disposed in the open or internal channel 42 of a vertical garage door rail 28. The open or interior channels 42 in conjunction with the roller brackets 54 and rollers 56 function to align the garage door panels 20 during elevation or lowering, to open or close a garage door 68.

Figure 10:
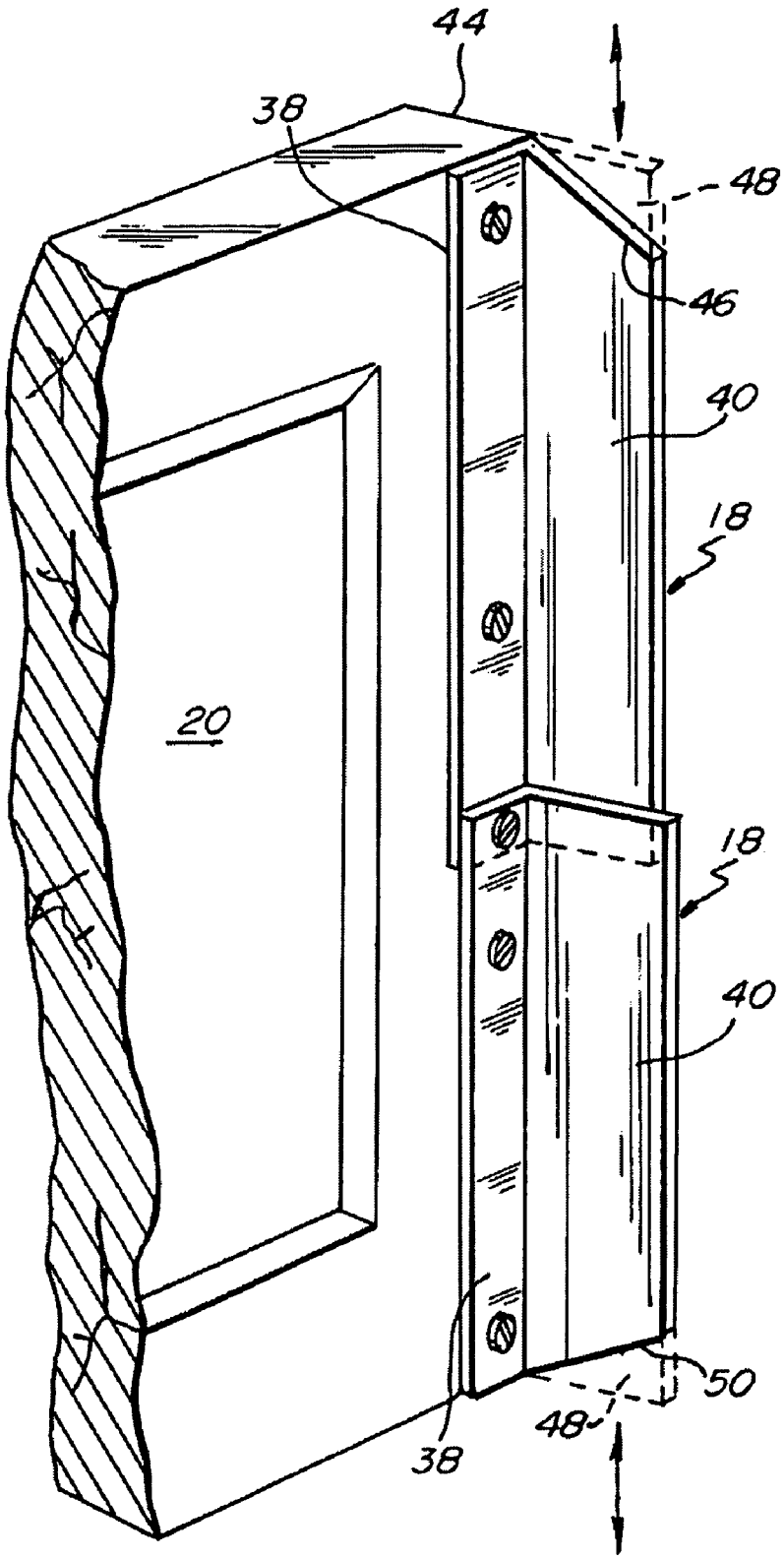
FIG. 10 is a detail isometric view of an alternative panel shield.

In at least one embodiment, two panel shields 18 are positioned and affixed in overlapping relationship to each other proximate to each exterior edge 44 of each garage door panel 20. The overlap positioning of two panel shields 18 relative to each other enables the two panel shields 18 to be expanded or contracted in the vertical direction, dependant on the vertical size of each garage door panel 20. Standardized sized panel shields 18 may then be formed for use with a variety of alternatively sized garage door panels 20. (FIG. 10)

In at least one embodiment, the plurality of panel shields 18 are vertically disposed on adjacent garage door panels 20 proximate to the exterior edges 44. The plurality of vertically disposed panel shields 18 generally extend from a location proximate to a garage floor upwardly to a position proximate to the upper curve 34 of the vertical rails 28.

In some embodiments, the panel shield faces 40 of the panel shields 18 are positioned proximate to, and in covering relationship over, a portion of the open or interior channel 42 of the vertical rails 28.

In at least one embodiment, each panel shield 18 includes an upper edge 46 and a lower edge 50. The lower edge 50 of the panel shield 18 engaged to the bottom garage door panel 20 is generally positioned proximate to a garage floor when the garage door 68 is closed. Upper edge 46 of the top panel shield 18, engaged to the top garage door panel 20, is positioned proximate to the upper curve 34 of the vertical rail 28 when the garage door 68 is closed. In at least one embodiment, the upper edge 46 of each panel shield 18 extends outwardly from the top of the engagement leg 38 to the most distal upper point of the panel shield face 40.

In at least one embodiment, the lower edge 50 includes an angular cutout 48. The angular cutout 48 may extend the entire length dimension of the lower edge 50 or may be a portion of the lower edge 50. The angular cutout 48 from the loser edge 50 may be selected to have a 45° angle upwardly from horizontal, or may have any other angular offset as desired by an individual. The vertex of the angle for the cutout 48 is proximate to the engagement leg 38 of the panel shield 18.

In some embodiments, the upper edge 46 of the panel shield faces 40 are substantially horizontal. Therefore, as the individual panels 20 of the garage door 68 are elevated through the upper curve 34 of the vertical rails 28, the lower edges 50 of the panel shield faces 40 pivot downwardly towards the upper edge 46 of an adjacent paneled shield 18. The angular cutout 48 thereby provides a space for the downward pivotal rotation of a lower edge 50 toward an adjacent upper edge 46 to minimize risk of contact between adjacent panel shields 18.

In at least one embodiment, the lower edge 50 of the lower most panel shield face 40 includes a curved portion 52 disposed inwardly toward the vertical rail 28. The curved portion 52 is constructed to facilitate the slidable downward internal positioning of the panel shield faces 40 interior to the paneled shield face side 64 of the U-shaped end covering shield 22.

In some embodiments, each lower edge 50 of each panel shield face 40 includes a curved portion 52 disposed inwardly towards the vertical rail 28. In other embodiments, no lower edge 50 of a panel shield face 40 includes a curved portion 52.

In some embodiments, the panel shields 18, engagement legs 38, and panel shield faces 40 are formed of materials other than plastic as earlier described.

In some embodiments, a U-shaped end covering shield 22 is engaged to the shield face 26 of the rail shield 12 and is positioned to the exterior of the panel shield faces 40 of the panel shields 18. The U-shaped end covering shield 22 may include a rail shield face side 60, a transition shield 62, and a panel shield face side 64. The U-shaped end covering shield 22 is generally constructed to facilitate slidable passing engagement between the panel shield faces 40 as proximate and interior to the panel shield face side 64 during elevation and/or descent of the garage door panels 20.

In at least one embodiment, the U-shaped end covering shield 22 extends vertically from a position proximate to a garage floor to a position proximate to the upper curve 34 of the garage door vertical rail 28.

In some embodiments, the rail shield face side 60 is mechanically and/or chemically engaged to the shield face 26. Mechanical elements such as screws, bolts and nuts, nails, rivets, snaps, mating channels and/or penetrating and receiving members may be used to engage a rail shield face side 60 to a shield face 26 as earlier described. The examples of the mechanical engagement elements identified herein are not exhaustive and may include other mechanical fastening elements at the discretion of an individual. Examples of adhesives include, but are not necessarily limited to the compounds and/or combination of elements as earlier described.

In some embodiments, the U-shaped end covering shield 22, rail shield face side 60, transition shield 62, and/or panel shield face side 64 are formed of materials other than plastic, for example, materials such as wood, aluminum, carbon steel, fiberglass, stainless steel, and composite materials may be used. In some embodiments, the U-shaped end covering shield 22 is formed of sufficiently sturdy material to not fracture and/or fail during the enclosure of the garage door rack assembly.

In at least one embodiment, the transition shield 62 traverses and/or extends between the rail shield face side 60 and the panel shield face side 64 exterior and proximate to the outer edge 66 of the vertical rails 28. The transition shield 62 may be integral with, or attached to, the rail shield face side 60 and the panel shield face side 64. The transition shield 62 generally functions as an end cap for the safety shield 10 covering the distal, exterior, or outer edge 66 of the vertical rail 28.

Figure 2:
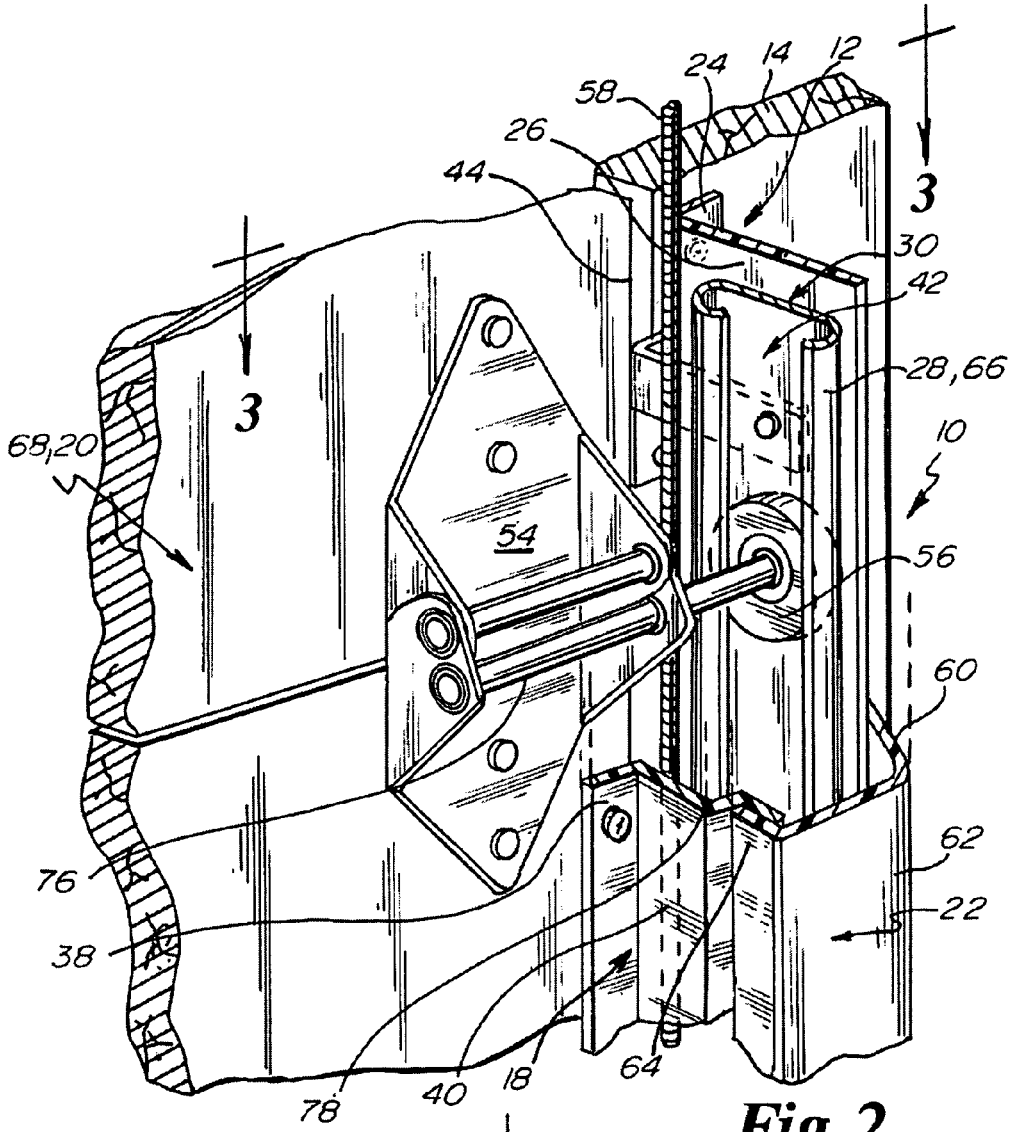
FIG. 2 is a detail isometric environmental view of the safety shield proximate to a roller bracket of a garage door rack assembly.

In some embodiments, the transition shield 62 is substantially planar or straight (FIG. 2). In alternative embodiments, the transition shield 62 may be curved or another shape as desired by an individual. (FIGS. 3, 4, and 5)

Figure 4A:
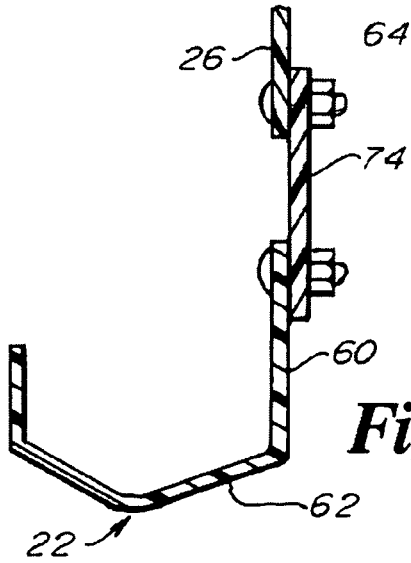
FIG. 4A is a partial detail top view of an expansion shield of FIG. 4.
Figure 7:
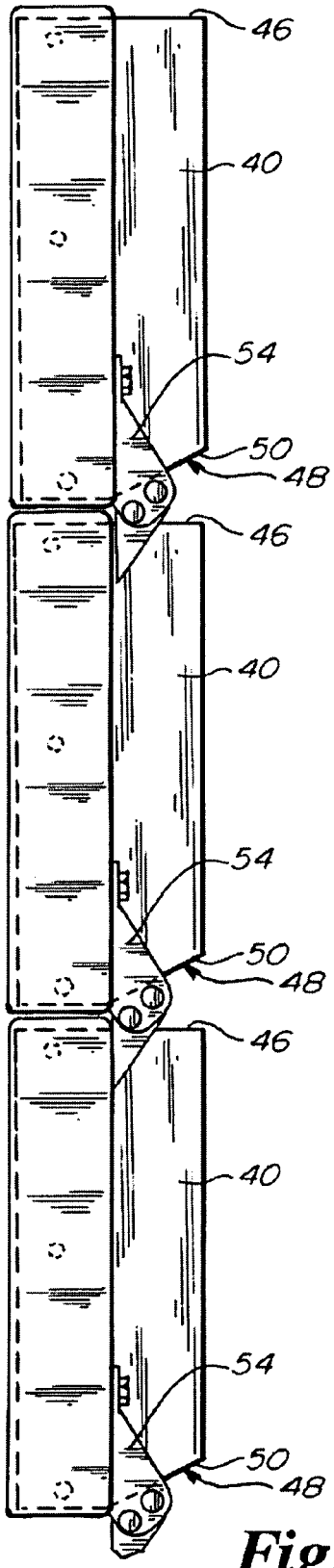
FIG. 7 is a side view of one embodiment of the safety shield.

In at least one embodiment, the rail shield face side 60 of the U-shaped end covering shield 22 is engaged to the expansion shield 74, which in turn is engaged to the shield face 26 of the rail shield 12. The expansion shield 74 may be used when a relatively large separation distance exists between the vertical rails 28 and the vertical surface 14 of a garage wall. Alternatively, the width dimension selected for the shield face 26 and the rail shield face side 60 permits either outward or inward overlap positioning of the U-shaped end covering shield 22 with respect to the rail shield 12, dependent upon the separation distance of the vertical rail 28 from the vertical surface 14 of a structure. (FIGS. 3, 4, and 4A)

In at least one embodiment, the rail shield 12 is initially engaged to the vertical surface 14. An individual may then measure the separation distance between the vertical rail 28 and the vertical surface 14. If the width dimension for the shield face 26 is sufficient to cover the separation distance, then the rail shield face side 60 of the U-shaped end covering shield 22 may be engaged to the shield face 26, for positioning of the transition shield 62 exterior to the outer edge 66 of the vertical rail 28. Alternatively, in configurations where the width dimension of the shield face 26 is not sufficiently large to enable positioning of the transition shield 62 to the exterior of the outer edge 66 of the vertical rail 28, then an individual may utilize an expansion shield 74. In this embodiment, one portion of the expansion shield 74 may be engaged to the shield face 26, and another portion of the expansion shield 74 may be engaged to the rail shield face side 60, so that a sufficient width dimension is provided to position the transition shield 62 exterior to the outer edge 66 of the vertical rail 28.

In some embodiments, the panel shield face side 64 includes a top edge 70 having an arcuate surface 72 disposed outwardly from the vertical rail 28. The arcuate surface 72 may be constructed for engagement to the curved portion 52 of the lower edge 50 of the panel shield faces 40 to permit slidable downward passage therebetween. The panel shield face side 64 is primarily stationary, where the panel shield faces 40 slide upwardly during opening, and downwardly during closing, of the garage door 68. The panel shield faces 40 are positioned interior to the panel shield face side 60 during use of the safety shield 10.

In at least one embodiment, the arcuate surface 72 extends along a portion of the top edge 70. In alternative embodiments, the arcuate surface 72 extends along the entire length dimension of the top edge 70.

In some embodiments, an expansion shield 74 may be engaged to a panel shield face side 60. In this embodiment, the vertical rails 28 may have a relatively larger separation distance from the vertical surface 14. The width dimension provided for the panel shield faces 40 and the panel shield face side 60 is preferably sufficient to completely enclose or cover the open or internal channel 42 of the vertical rails 28 and the space between the vertical rails 28 and the vertical surface 14.

In some embodiments, the width dimension selected for the panel shield faces 40 and the panel shield face sides 64 are sufficiently large to provide an overlap between the panel shield faces 40 and the panel shield face sides 60. In addition, in this embodiment, the width dimension selected for the panel shield faces 40 and the panel shield face side 64 is sufficiently large to extend between the vertical surface 14 to the outer edge 66 of the vertical rail 28.

In at least one embodiment, the rail shield 12 having the mounting leg 24 and the shield face 26 is either molded or extruded of sturdy plastic material. In some embodiments, the panel shields 18 having the engagement leg 38 and panel shield faces 40 are either molded or extruded of sturdy plastic material. In at least one embodiment, the U-shaped end covering shield 22 having the rail shield face side 60, the transition shield 62, and the panel shield face side 64 is either molded or extruded of sturdy plastic material.

In some embodiments, each of the rail shields 12, panel shields 18, and/or U-shaped end covering shields 22 are integral one piece units. In alternative embodiments, the rail shield 12, panel shields 18, and/or U-shaped end covering shield 22 may be formed of one or more separate component elements.

Figure 8:
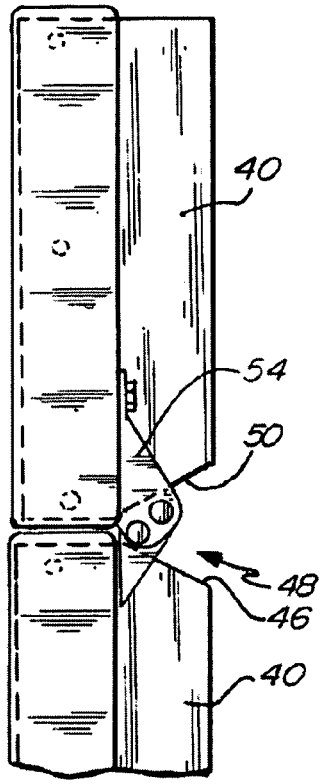
FIG. 8 is an alternative side view of one embodiment of the safety shield.

In at least one embodiment as shown in FIG. 8, the angular cutout 48 may be placed on an upper edge 46 of panel shield face 40. Therefore, the angular cutout 48 may be located on one of the upper edges 46 or lower edges 50 of the panel shield faces 40, or on both the upper edges 46 and lower edges 50 simultaneously.

In addition, in at least one embodiment as depicted in FIG. 8, the angular cutout 48 of the upper edges 46 may extend downwardly and outwardly from a position proximate to the engagement leg 38, to the distal end of a panel shield face 40. The angular cutout 48 of the lower edges 50 may alternatively extend either upwardly or horizontally, and outwardly from a position proximate to the engagement leg 38 to the distal end of a panel shield face 40. (FIG. 8) Any desired angular cutout 48 may be incorporated into one or both of the upper edges 46 and lower edges 50 to facilitate rotational positioning of a lower edge 50 relative to an upper edge 46 during elevation or lowering of a garage door panel 20 through the upper curve 34 of the vertical rails 28.

Figure 9:
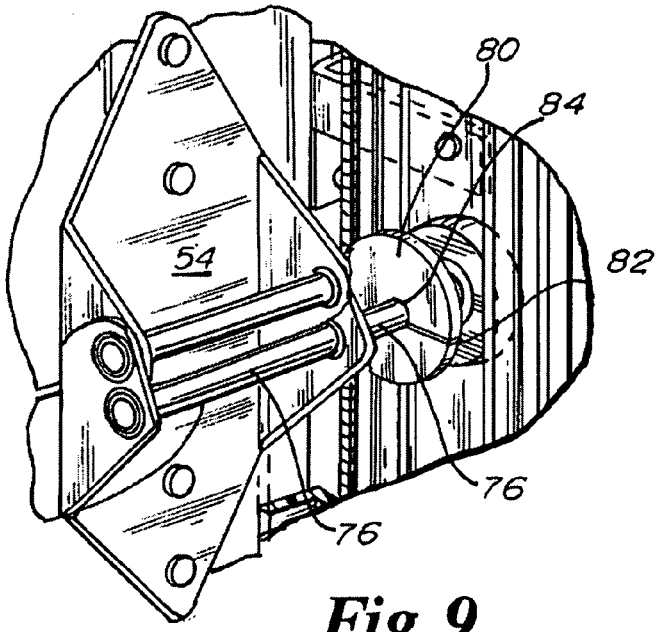
FIG. 9 is an alternate detail isometric environmental view of the roller disk shield proximate to a roller bracket of a garage door rack assembly.

In some embodiments, as depicted in FIG. 9, a roller disk shield 80 having an opening slot 82 may be disposed about one or more roller shafts 76. The roller disk shields 80 are preferably positioned exterior to the open channel 42 of the garage door rails 28.

In some embodiments, a roller disk shield 80 may be engaged to a roller shaft 76 by manipulating the sides of the roller disk 80 in opposite directions proximate to the opening slot 82, to position a central opening 84 around the roller shaft 76. The roller disc shield 80 preferably functions as a supplemental shield to cover the edges of the open channel 42 proximate to the roller shaft 76. The roller disk shield 80 is preferably constructed to move upwardly and downwardly along the exterior of the open channel 42 of the garage door rails 28. The roller disk shield 80 is also preferably constructed for positioning interior to both of the panel shield faces 40 and the panel shield face side 64.

In some embodiments, the rail shield 12 and the U-shaped end covering shield 22 are integral one piece units. In this embodiment, the rail shield 12 will include the majority of the elements of the U-shaped end covering shield 22 for positioning exterior to the vertical rail 28 and exterior to the panel shield faces 40.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below (e.g. claim 3 may be taken as alternatively dependent from claim 2; claim 4 may be taken as alternatively dependent on claim 2, or on claim 3; claim 6 may be taken as alternatively dependent from claim 5; etc.).

This completes the description of the preferred and alternate embodiments of the invention. Those skilled in the art may recognize other equivalents to the specific embodiment described herein which equivalents are intended to be encompassed by the claims attached hereto.

The invention claimed is:

1. A safety shield for use with a garage door assembly having a plurality of garage door panels and one or more garage door rails formed of a vertical rail and an upper curve, the safety shield comprising:

a) an elongate L-shaped rail shield engaged to a vertical surface adjacent an interior of said garage door, said elongate L-shaped rail shield extending from a location adjacent a bottom of a garage door opening to a location adjacent a top of the garage door opening;

b) a plurality of panel shields, each of said panel shields being engaged to the interior of a respective one of said garage door panels and positioned exteriorly to said vertical rail, each of said panel shields extending from a location adjacent a bottom edge of the respective one of said garage door panels to a location adjacent a top edge of the respective one of said garage door panels; and c) an elongate generally U-shaped end covering shield engaged to said L-shaped rail shield, said panel shields being positioned interior to said U-shaped end covering shield, said elongate generally U-shaped end covering shield extending from the location adjacent the bottom of the garage door opening to the location adjacent the top of the garage door opening.

2. The safety shield according to claim 1, said L-shaped rail shield comprising a mounting leg and a rail shield face extending substantially perpendicular to said mounting leg.

3. The safety shield according to claim 2, wherein said mounting leg is constructed for positioning proximate to said vertical surface and said rail shield face extends substantially perpendicularly outward from said vertical surface.

4. The safety shield according to claim 2, wherein said rail shield face is constructed for positioning proximate to a closed back surface of said vertical rail.

5. The safety shield according to claim 4, wherein said L-shaped rail shield is constructed to vertically extend from a location proximate to a garage floor to a position proximate to an upper curve of the garage door rail.

6. The safety shield according to claim 5, each of said panel shields further comprising an engagement leg and a panel shield face extending substantially perpendicularly to said engagement leg.

7. The safety shield according to claim 6, wherein each of said engagement legs is constructed for engagement to the interior of one of said plurality of garage door panels.

8. The safety shield according to claim 7, wherein each of said panel shield faces is constructed to extend substantially perpendicularly outward from said engagement legs.

9. The safety shield according to claim 7, wherein each of said panel shield faces is constructed for positioning proximate to a portion of an open channel of the vertical rail.

10. The safety shield according to claim 9, wherein each of said panel shields is constructed for vertical positioning proximate to an exterior edge of one of said plurality of garage door panels.

11. The safety shield according to claim 9, wherein, in combination, said plurality of panel shields extend from the location proximate to said garage floor to a position proximate to the upper curve of the garage door rail.

12. The safety shield according to claim 11, said at least one of said panel shield faces comprising an edge comprising an angular cutout.

13. The safety shield according to claim 12, said at least one of said panel shield faces comprising a lower edge having a curved portion disposed inwardly toward said vertical rail.

14. The safety shield according to claim 11, wherein at least one of said panel shield faces comprises a lower edge and an upper edge, said lower edge of said at least one panel shield face and said upper edge of an adjacent panel shield face are constructed for positioning proximate to each other and proximate to a roller bracket having a roller disposed in said open channel of the vertical rail.

15. The safety shield according to claim 14, wherein said panel shields are constructed for slidable positioning interior to said U-shaped end covering shield.

16. The safety shield according to claim 15, said U-shaped end covering shield comprising a rail shield face side, a transition shield, and a panel shield face side.

17. The safety shield according to claim 16, wherein said rail shield face side is constructed for engagement to said rail shield face.

18. The safety shield according to claim 17, wherein said panel shield face side is constructed for positioning proximate and exterior to said panel shield faces.

19. The safety shield according to claim 18, wherein said transition shield traverses between said rail shield face side and said panel shield face side.

20. The safety shield according to claim 19, wherein said transition shield is constructed for positioning proximate to an exterior edge of said vertical rail.

21. The safety shield according to claim 20, wherein said panel shield faces are constructed to slide vertically within the interior of the U-shaped end covering shield during elevation and/or closing of said garage door.

22. The safety shield according to claim 20, wherein the U-shaped end covering shield is constructed to vertically extend from the location proximate to said garage floor to the position proximate to the upper curve of the garage door rail.

23. The safety shield according to claim 22, said panel shield face side comprising a top edge.

24. The safety shield according to claim 23, said top edge comprising an arcuate surface disposed outwardly from said vertical rail.

25. The safety shield according to claim 24, wherein said arcuate surface is constructed to engage said curved portion of said lower edge of said at least one panel shield face to facilitate positioning of said panel shield faces interior to said panel shield face side.

26. A safety shield comprising:

a) a rail shield engaged to a vertical surface adjacent an interior of a garage door, said rail shield comprising a rail shield face, a transition shield, and a panel shield face side, said rail shield extending from a location adjacent a bottom of a garage door opening to a location adjacent a top of the garage door opening; and b) a plurality of panel shields, each of said panel shields being engaged to the interior of a respective garage door panel, at least a portion of said panel shields being constructed for positioning interior to said panel shield face side, each of said panel shields positioned exteriorly to a garage door rail, each of said panel shields extending from a location adjacent a bottom edge of said respective garage door panel to a location adjacent a top edge of said respective garage door panel, wherein said safety shield is configured to surround said garage door rail on at least three sides.

27. A safety shield for use with a garage door assembly, the garage door assembly having a garage door and at least one vertical rail, the garage door including at least one garage door panel, the safety shield comprising:

a) an elongate L-shaped rail shield engaged to a vertical surface adjacent an interior of the garage door, said elongate L-shaped rail shield extending from a location adjacent a bottom of a garage door opening to a location adjacent a top of the garage door opening;

b) a plurality of panel shields, each of the panel shields being fastened directly to the interior of a respective garage door panel and positioned exteriorly to said at least one vertical rail, each of said panel shields extending from a location adjacent a bottom edge of the respective garage door panel to a location adjacent a top edge of the respective garage door panel; and c) an elongate generally U-shaped end covering shield engaged to the L-shaped rail shield, the panel shields being positioned interior to the U-shaped end covering shield, said elongate generally U-shaped end covering shield extending from the location adjacent the bottom of the garage door opening to the location adjacent the top of the garage door opening, wherein the safety shield surrounds at least a portion of the vertical rail on at least three sides and defines a gap between the safety shield and the vertical rail on at least two of the at least three sides.

* * * * *